US011572818B2

(12) United States Patent
Lou et al.

(10) Patent No.: US 11,572,818 B2
(45) Date of Patent: Feb. 7, 2023

(54) SELF-ADAPTIVE OIL SPRAYING CONTROL SYSTEM AND METHOD FOR BIODIESEL ENGINE

(71) Applicant: TONGJI UNIVERSITY, Shanghai (CN)

(72) Inventors: Diming Lou, Shanghai (CN); Yinghua Zhao, Shanghai (CN); Piqiang Tan, Shanghai (CN); Yunhua Zhang, Shanghai (CN); Liang Fang, Shanghai (CN); Zhiyuan Hu, Shanghai (CN)

(73) Assignee: TONGJI UNIVERSITY, Shanghai (CN)

( * ) Notice: Subject to any disclaimer, the term of this patent is extended or adjusted under 35 U.S.C. 154(b) by 0 days.

(21) Appl. No.: 17/214,948

(22) Filed: Mar. 29, 2021

(65) Prior Publication Data

US 2022/0099010 A1 Mar. 31, 2022

(30) Foreign Application Priority Data

Sep. 27, 2020 (CN) ..... 202011036263.X

(51) Int. Cl.

| | |
|---|---|
| ***F01N 3/20*** | (2006.01) |
| ***F01N 11/00*** | (2006.01) |
| ***F02D 41/14*** | (2006.01) |

(52) U.S. Cl.

CPC ..... *F01N 3/208* (2013.01); *F01N 11/00* (2013.01); *F01N 2560/026* (2013.01); (Continued)

(58) Field of Classification Search

CPC .... F01N 3/208; F01N 11/00; F01N 2560/026; F01N 2610/146; F01N 2900/0402; (Continued)

(56) References Cited

U.S. PATENT DOCUMENTS

2011/0162628 A1* 7/2011 Kurtz ..... F02D 41/1454 123/672

2013/0269317 A1* 10/2013 Narayanaswamy ..... F02D 41/0082 60/274

(Continued)

FOREIGN PATENT DOCUMENTS

| | | |
|---|---|---|
| CN | 101858877 | 10/2010 |
| CN | 106381230 | 2/2017 |
| CN | 108410531 | 8/2018 |

*Primary Examiner* — Brandon D Lee

(74) *Attorney, Agent, or Firm* — JCIP Global Inc.

(57) ABSTRACT

The disclosure relates to a self-adaptive oil spraying control system and method for a biodiesel engine. The control system includes an exhaust pipe, a gas sensor, a control module and an oil sprayer, wherein the exhaust pipe is connected to the oil sprayer, the gas sensor is mounted in the exhaust pipe, and the gas sensor and the oil sprayer are connected to the control module respectively. According to the control method, a main spray advance angle of the engine is subjected to closed-loop control directly through comparison between an idling steady state $NO_x$ emission signal and an idling steady state $NO_x$ emission value of pure diesel when the engine uses the biodiesel, so that emission of $NO_x$ in the exhaust is reduced. Compared with the prior art, the disclosure has the advantages of no need of detecting a biodiesel ratio, high efficiency, good effect and the like.

8 Claims, 3 Drawing Sheets

(52) U.S. Cl.
CPC *F01N 2610/146* (2013.01); *F01N 2900/0402* (2013.01); *F01N 2900/0408* (2013.01); *F01N 2900/1614* (2013.01); *F02D 41/146* (2013.01)

(58) Field of Classification Search
CPC ..... F01N 2900/0408; F01N 2900/1614; F02D 41/146
See application file for complete search history.

(56) References Cited

U.S. PATENT DOCUMENTS

| | | | | |
|---|---|---|---|---|
| 2014/0222314 | A1* | 8/2014 | Kurtz | F02D 41/403 701/104 |
| 2017/0211493 | A1* | 7/2017 | Kidd | F02D 41/1402 |
| 2021/0132587 | A1* | 5/2021 | Lawrence | G06N 20/00 |

* cited by examiner

SELF-ADAPTIVE OIL SPRAYING CONTROL SYSTEM AND METHOD FOR BIODIESEL ENGINE

CROSS-REFERENCE TO RELATED APPLICATION

This application claims the priority benefit of China application serial no. 202011036263.X, filed on Sep. 27, 2020. The entirety of the above-mentioned patent application is hereby incorporated by reference herein and made a part of this specification.

FIELD OF TECHNOLOGY

The disclosure relates to the technical field of biodiesel spraying control, and in particular, to a self-adaptive oil spraying control system and method for a biodiesel engine.

BACKGROUND

Compared with the traditional diesel engine, the biodiesel engine has the characteristic of high $NO_x$ emission. Therefore, how to reduce $NO_x$ emission is the research focus of the biodiesel engine. The existing patent CN201610826273.0 improves the preparation process of the biodiesel to obtain modified biodiesel, thereby reducing $NO_x$ emission. The existing patent CN201810091332.3 improves the proportion and preparation method of the biodiesel so as to greatly reduce harmful components in engine tail gas. It may be seen that the above patents reduce the $NO_x$ emission of the biodiesel engine by directly improving fuel. However, at present, there are few technologies to solve the problem of high $NO_x$ emission of the biodiesel engine by directly using the internal purification technology of the biodiesel engine. The existing patent CN201010191235.5 determines the proportion of the biodiesel by measuring the relative dielectric constant value of the biodiesel mixed fuel with different mixing ratios, and then studies how to improve the usability of the biodiesel engine.

It can be seen that in the prior art, reducing the high $NO_x$ emission of the biodiesel engine is all studied on the basis of the biodiesel itself, and there is no control system and method for the engine to reduce the $NO_x$ emission of the biodiesel engine.

SUMMARY

An objective of the disclosure is to provide a self-adaptive oil spraying control system and method for a biodiesel engine, which do not need to detect the proportion of the biodiesel and have high efficiency and good effect so as to overcome the defects in the prior art.

The objective of the disclosure may be achieved by the following technical solutions:

a self-adaptive oil spraying control system for a biodiesel engine includes an exhaust pipe, a gas sensor, a control module and an oil sprayer, wherein the exhaust pipe is connected to the oil sprayer; the gas sensor is mounted in the exhaust pipe; the gas sensor and the oil sprayer are connected to the control module respectively; and a self-adaptive oil spraying control program is embedded in the control module.

Preferably, there are a plurality of oil sprayers; and the plurality of oil sprayers are connected to the control module respectively.

Preferably, the temperature sensor is a $NO_x$ sensor.

Preferably, the control module is a vehicle-mounted electronic control unit (ECU).

A self-adaptive oil spraying control method for a biodiesel engine applied to the oil spraying control system includes:

Step 1: acquiring a $NO_x$ emission standard value;

Step 2: acquiring a $NO_x$ steady state emission value in real time;

Step 3: determining whether the $NO_x$ steady emission value acquired in Step 2 is greater than the $NO_x$ emission standard value, if yes, performing Step 6, otherwise, performing step 7;

Step 4: performing self-adaptive control on main spray timing according to a difference value between the $NO_x$ steady state emission value and the $NO_x$ emission standard value until the difference value between the $NO_x$ steady state emission value and the $NO_x$ emission standard value is zero, and then performing Step 5;

Step 5: determining whether a delay angle of the main spray timing is greater than zero, if yes, performing Step 6, otherwise, performing Step 7;

Step 6: adjusting oil spraying map in the ECU and then returning to Step 3; and

Step 7: completing self-adaptive oil spraying control.

Preferably, the Step 1 is as follows:

starting the engine added with pure diesel, controlling the engine to be stable under the working condition of idling, acquiring an output signal of a $NO_x$ sensor by the control module, and acquiring a $NO_x$ steady state emission value to serve as a $NO_x$ emission standard value.

Preferably, the Step 2 is as follows:

starting the engine added with biodiesel in any proportion, controlling the engine to be stable under the working condition of idling, acquiring an output signal of a $NO_x$ sensor by the control module, and acquiring a $NO_x$ steady state emission value in real time.

Preferably, self-adaptive control in the Step 4 is closed loop feedback control.

More preferably, a transfer function of the closed loop feedback control is as follows:

$$G_1(s) = \frac{R(s)}{Y(s)} = \frac{K_p + \frac{K_i}{s} + K_d s}{H(s)}$$

wherein H(s) is a feedback control function, $K_p$ is a proportional constant, $K_i$ is an integration constant, and $K_d$ is a differential constant.

Preferably, the Step 6 is as follows:

if the delay angle of the main spray timing is greater than zero, the oil spraying map in the ECU is adjusted, and all the main spray timing in the oil spraying map is delayed according to the delay angle of the main spray timing.

Compared with the prior art, the disclosure has the following advantages:

the disclosure provides a self-adaptive oil spraying control system and method for a biodiesel engine, which perform closed loop control on the main spray advance angle of the engine by directly comparing an idling steady state $NO_x$ emission signal and an idling steady state $NO_x$ emission value of pure diesel instead of detecting the proportion of the biodiesel outside or inside the engine, thereby reducing the $NO_x$ emission in the exhaust. By taking the engine added with B20 biodiesel as an example, the $NO_x$ emission of the engine can be reduced by about 15% and 10% respectively under the conditions normal rotating speed, medium load and external characteristic while the engine power is ensured, so that higher efficiency is achieved, and work stability and emission reduction of the biodiesel engine are ensured.

Figure 1:
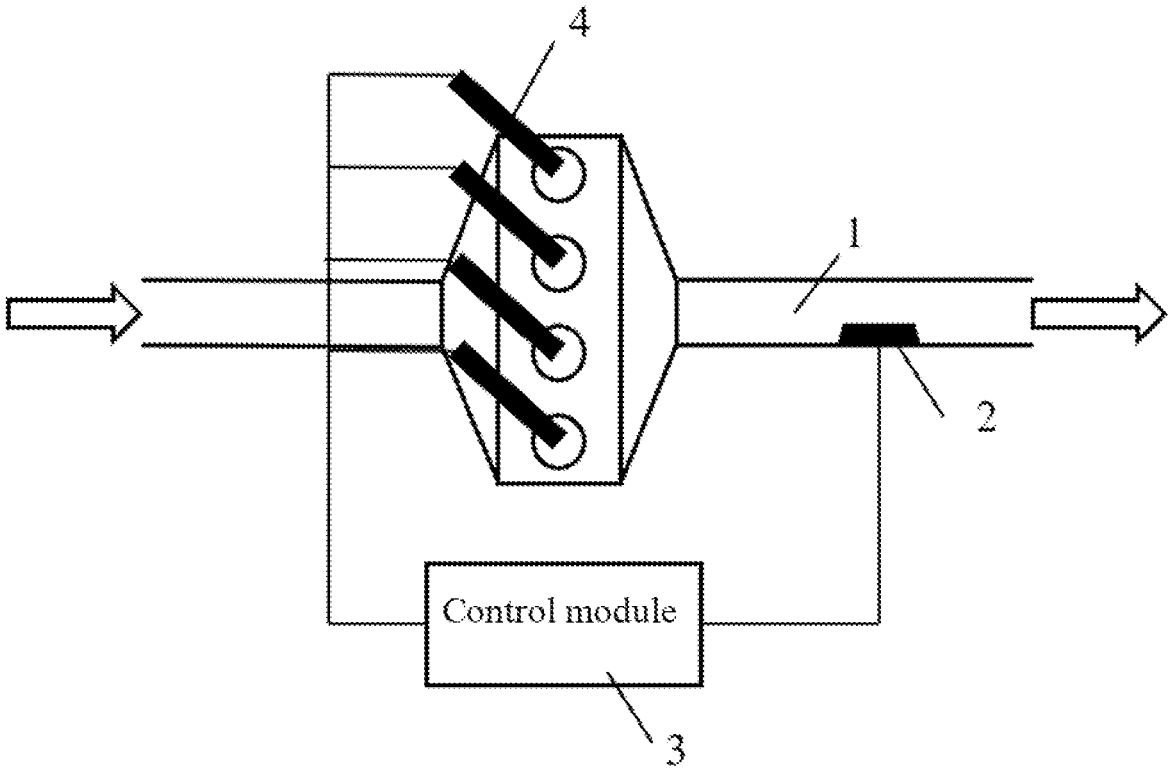
FIG. 1 is a self-adaptive oil spraying control system for a biodiesel engine according to the disclosure.

The reference numerals in the drawings are as follows:

Exhaust pipe, 2. Gas sensor, 3, control module, 4. Oil sprayer.

DESCRIPTION OF THE EMBODIMENTS

The technical solutions in embodiments of the disclosure are described clearly and completely below with reference to the accompanying drawings in the embodiments of the disclosure. Obviously, the described embodiments are merely a part of embodiments of the disclosure and not all the embodiments. Based on the embodiments of the disclosure, all of other embodiments obtained by a person of ordinary skill in the art without any creative effort shall belong to the protection scope of the disclosure.

A self-adaptive oil spraying control system for a biodiesel engine has a structure shown in FIG. 1 and includes an exhaust pipe 1, a gas sensor 2, a control module 3 and an oil sprayer 4, wherein the exhaust pipe 1 is connected to the oil sprayer 4, the gas sensor 2 is mounted in the exhaust pipe 1, the gas sensor 2 and the oil sprayer 4 are connected to the control module 3 respectively, and a self-adaptive oil spraying control program is embedded in the control module 3.

There is a plurality of oil sprayers 4, and the plurality of oil sprayers 4 are connected to the control module 3 respectively; the gas sensor 2 is a $NO_x$ sensor; and the control module 3 is a vehicle-mounted ECU.

Figure 2:
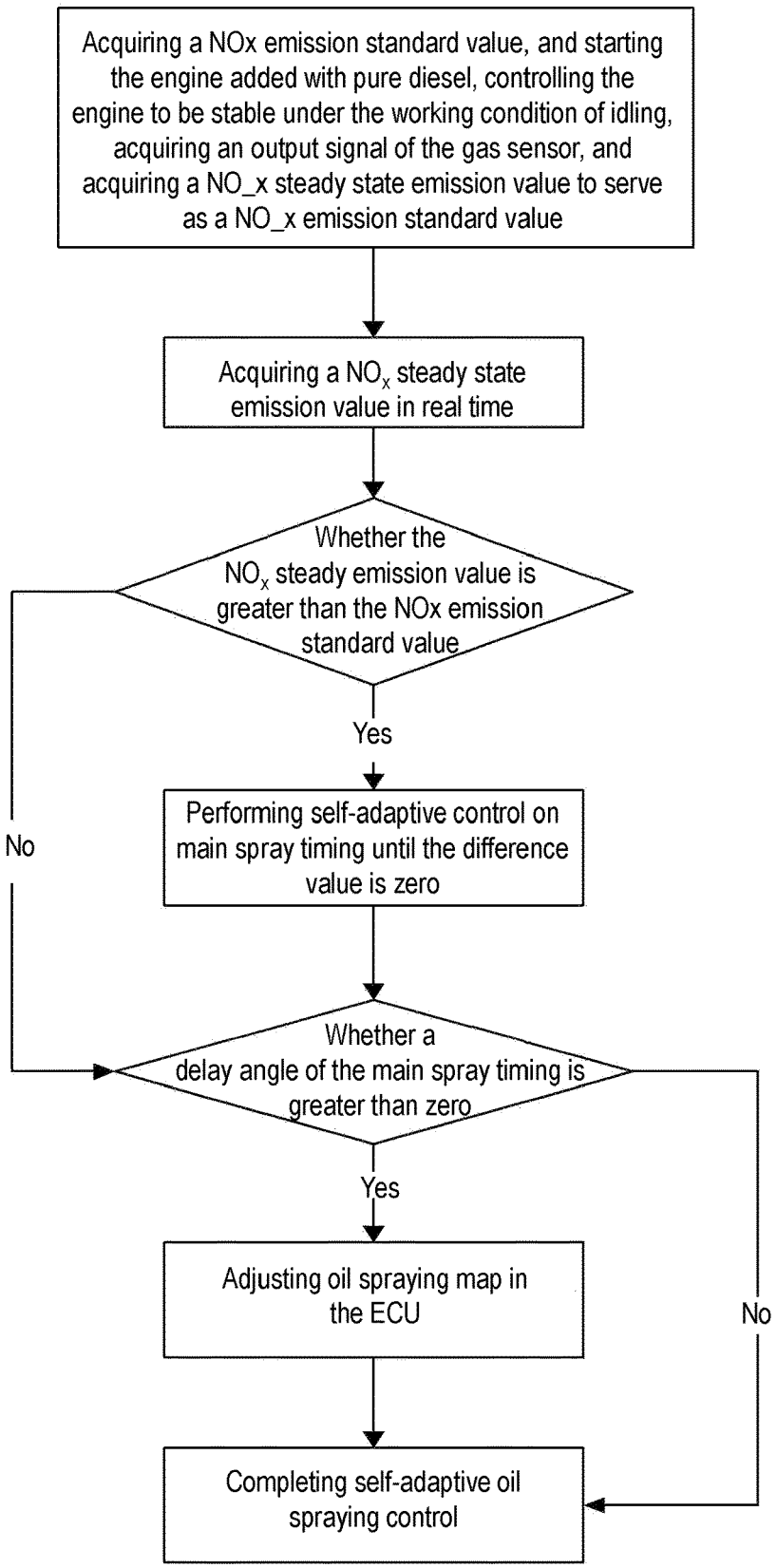
FIG. 2 is a schematic flowchart of a self-adaptive oil spraying control method for a biodiesel engine according to the disclosure.

A self-adaptive oil spraying control method for a biodiesel engine applied to the oil spraying control system, of which the schematic flowchart is as shown in FIG. 2, includes:

Step 1: a $NO_x$ emission standard value is acquired, which is as follows:

the engine added with pure diesel is started, the engine is controlled to be stable under the working condition of idling, an output signal of a $NO_x$ sensor is acquired by the control module, and a $NO_x$ steady state emission value is acquired to serve as a $NO_x$ emission standard value.

Step 2: a $NO_x$ steady state emission value is acquired in real time, which is as follows:

the engine added with biodiesel in any proportion is started, the engine is controlled to be stable under the working condition of idling, an output signal of a $NO_x$ sensor is acquired by the control module, and a $NO_x$ steady state emission value is acquired in real time.

Step 3: determining whether the $NO_x$ steady emission value acquired in Step 2 is greater than the $NO_x$ emission standard value, if yes, performing Step 4, otherwise, performing Step 5;

Step 4: main spray timing is subjected to self-adaptive control according to a difference value between the $NO_x$ steady state emission value and the $NO_x$ emission standard value until the difference value between the $NO_x$ steady state emission value and the $NO_x$ emission standard value is zero, and then Step 5 is performed.

Figure 3:
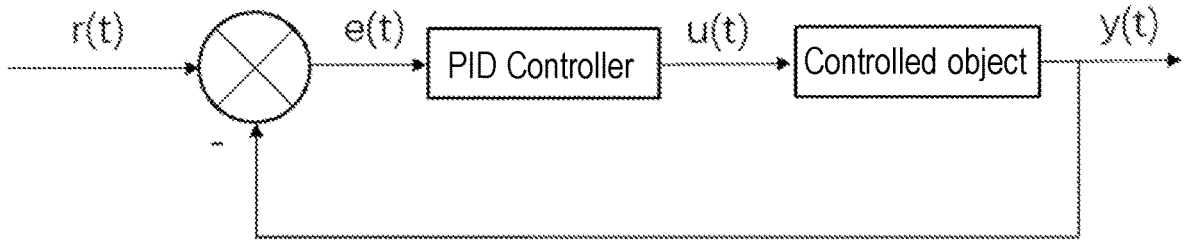
FIG. 3 is a closed loop feed control according to the disclosure.
Figure 4:
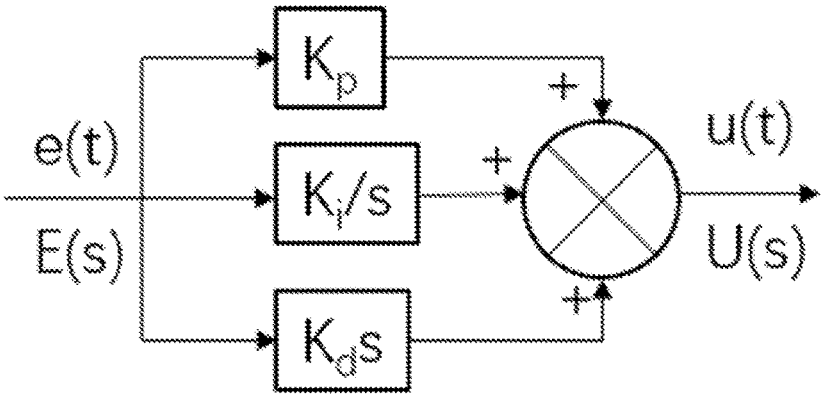
FIG. 4 is a PID controller according to the disclosure.

As shown in FIG. 3, the closed loop feedback control in the embodiment adopts PID control. According to the error of the system, the PID controller calculates the control quantity by using proportion, integration and differential for control. The PID control principle is as shown in FIG. 4, wherein r(t) is input quantity, y(t) is output quantity, e(t) is deviation value, u(t) is output quantity of PID controller, and the controlled object is main spray timing. For this example, r(t) represents $NO_x$ emission standard value, y(t) represents $NO_x$ steady state emission value, and e(t) is deviation value.

A transfer function of the PID controller is:

$$G(s) = \frac{U(s)}{E(s)} = K_p + \frac{K_i}{s} + K_d s$$

A transfer function of the closed loop feedback control is:

$$G_1(s) = \frac{R(s)}{Y(s)} = \frac{K_p + \frac{K_i}{s} + K_d s}{H(s)}$$

wherein H(s) is a feedback control function, $K_p$ is a proportional constant, $K_i$ is an integration constant, and $K_d$ is a differential constant.

During actual application of the closed ring control system, the proportion constant, the integration constant and the differential constant need to be calibrated according to the actual requirement. The embodiment provides a simple calibration method:

1. Determination of $K_p$

When the proportion constant $K_p$ is determined, the integration constant and the differential constant of PID are removed firstly, that is, $K_i=K_d=0$, and the PID is pure proportional regulation.

The input is set as 60% to 70% of the maximum allowed by the system, and the proportion gain P is gradually increased from 0 until the system oscillates.

Conversely, the proportion constant $K_p$ at this time is gradually reduced until the system oscillation disappears, the proportion gain P at this time is recorded, $K_p$ of the PID is set as 60% to 70% of the current value, and so far, $K_p$ debugging is completed.

2. Determination of $K_i$

After the proportion constant $K_p$ is determined, a larger initial value of a integration constant $K_i$ is set, and then the $K_i$ is gradually reduced until the system oscillates. Conversely, the $K_i$ is gradually increased until the system oscillation disappears. The $K_i$ at this time is recorded, the integration constant $K_i$ of the PID is set as 150% to 180% of the current value, and so far, $K_i$ debugging is completed.

3. Determination of differential constant $K_d$

Generally, it is unnecessary to set the differential constant $K_d$ which is just 0. If necessary, the setting method is as same as the method for determining $K_p$ and $K_i$, and the differential constant is set as 30% when there is no oscillation.

Step 5: whether a delay angle of the main spray timing is greater than zero is determined, if yes, Step 6 is performed, otherwise, Step 7 is performed;

Step 6: oil spraying map in the ECU is adjusted and then it is returned to Step 3, which is as follows:

if the delay angle of the main spray timing is greater than zero, the oil spraying map in the ECU is adjusted, and all the main spray timing in the oil spraying map is delayed according to the delay angle of the main spray timing; and Step 7: self-adaptive oil spraying control is completed.

A specific calculation example is provided as follows:

by taking a certain type of biodiesel engine as an example, to implement the self-adaptive oil spraying control system and method for the biodiesel engine, pure diesel is added to the engine at first, and the engine operates stably to the working condition of idling to acquire a $NO_x$ emission standard value of the engine. By taking the biodiesel engine added with biodiesel in a certain ratio as an example (it is unnecessary to know the specific proportion of the biodiesel), after the engine operates stably to the working condition of idling, a $NO_x$ steady state emission discharge value is acquired in real time, and the main spray timing of the engine is subjected to self-adaptive adjustment by the closed ring control system. Parameters of the PID controller are calibrated according to the simple calibration mode, for example, the final calibration results of $K_p$, $K_i$ and $K_d$ in this example are 4, 2 and 0.5, the system is stable after 1 s, and the main spray timing is delayed by 4° CA compared with the original engine.

After the main spray timing in the oil spraying map in the ECU is delayed by 4° CA, self-adaptive oil spraying control is completed. When the engine uses B20 biodiesel to operate under various working conditions, the $NO_x$ emission can be improved to varying degrees.

The above merely describes specific embodiments of the disclosure, but the protection scope of the disclosure is not limited thereto. Any person skilled in the art may easily conceive equivalent modifications or substitutions within the technical scope of the disclosure, and these modifications or substitutions shall fall within the protection scope of the disclosure. Therefore, the protection scope of the present invention should be determined with reference to the appended claims.

What is claimed is:

1. A self-adaptive oil spraying control system for a biodiesel engine, comprising an exhaust pipe, a gas sensor, an electronic control unit (ECU) and an oil sprayer, wherein the exhaust pipe is connected to the oil sprayer; the gas sensor is mounted in the exhaust pipe; the gas sensor and the oil sprayer are connected to the ECU respectively; and a self-adaptive oil spraying control program is embedded in the ECU, wherein the ECU is configured to acquire a $NO_x$ emission standard value, and the ECU is configured to start the engine added with pure diesel, control the engine to be stable under the working condition of idling, acquire an output signal of the gas sensor, and acquire a $NO_x$ steady state emission value to serve as the $NO_x$ emission standard value, wherein the gas sensor is a $NO_x$ sensor, wherein the ECU is configured to determine whether a delay angle of main spray timing is greater than zero, such that a main spray advance angle of the biodiesel engine is controlled by directly comparing an idling steady state $NO_x$ emission signal and an idling steady state $NO_x$ emission value of the pure diesel, without detecting a proportion of a biodiesel outside or inside of the engine.

2. The self-adaptive oil spraying control system for the biodiesel engine according to claim 1, wherein there is a plurality of oil sprayers; and the plurality of oil sprayers are connected to the ECU respectively.

3. The self-adaptive oil spraying control system for the biodiesel engine according to claim 1, wherein the ECU is a vehicle-mounted electronic control unit (ECU).

4. A self-adaptive oil spraying control method for a biodiesel engine applied to a self-adaptive oil spraying control system, wherein the self-adaptive oil spraying control method comprises:

Step 1: acquiring a $NO_x$ emission standard value;

Step 2: acquiring a $NO_x$ steady state emission value in real time;

Step 3: determining whether the $NO_x$ steady emission value acquired in Step 2 is greater than the $NO_x$ emission standard value, if yes, performing Step 4, otherwise, performing Step 5;

Step 4: performing self-adaptive control on main spray timing according to a difference value between the $NO_x$ steady state emission value and the $NO_x$ emission standard value until the difference value between the $NO_x$ steady state emission value and the $NO_x$ emission standard value is zero, and then performing Step 5;

Step 5: determining whether a delay angle of the main spray timing is greater than zero, if yes, performing Step 6, otherwise, performing Step 7, such that a main spray advance angle of the biodiesel engine is controlled by directly comparing an idling steady state $NO_x$ emission signal and an idling steady state $NO_x$ emission value of pure diesel, without detecting a proportion of a biodiesel outside or inside of the engine;

Step 6: adjusting oil spraying map in an electronic control unit (ECU) of the self-adaptive oil spraying control system and then returning to Step 3; and Step 7: completing self-adaptive oil spraying control, wherein the Step 1 is as follows:

starting the engine added with the pure diesel, controlling the engine to be stable under the working condition of idling, acquiring an output signal of a $NO_x$ sensor by the ECU, and the acquiring of the $NO_x$ steady state emission value to serve as the $NO_x$ emission standard value.

5. The self-adaptive oil spraying control method for the biodiesel oil engine according to claim 4, wherein the Step 2 is as follows:

starting the engine added with the biodiesel in any proportion, controlling the engine to be stable under the working condition of idling, acquiring the output signal of the $NO_x$ sensor by the ECU.

6. The self-adaptive oil spraying control method for the biodiesel oil engine according to claim 4, wherein the self-adaptive control in Step 4 is a closed loop feedback control.

7. The self-adaptive oil spraying control method for the biodiesel oil engine according to claim 6, wherein a transfer function of the closed loop feedback control is as follows:

$$G_1(s) = \frac{R(s)}{Y(s)} = \frac{K_p + \frac{K_i}{s} + K_d s}{H(s)}$$

H(s) being a feedback control function, $K_p$ being a proportional constant, $K_i$ being an integration constant, and $K_d$ being a differential constant.

8. The self-adaptive oil spraying control method for the biodiesel oil engine according to claim 4, wherein the Step 6 is as follows:

if the delay angle of the main spray timing is greater than zero, the oil spraying map in the ECU is adjusted, and all the main spray timing in the oil spraying map is delayed according to the delay angle of the main spray timing.

* * * * *